US005751662A

United States Patent [19]

Shaw

[11] Patent Number: 5,751,662

[45] Date of Patent: May 12, 1998

[54] ILLUMINATING TIMEPIECE

[76] Inventor: Sen-Yen Shaw, c/o Hung Hsing Patent Service Center P.O. Box 55-1670, Taipei, Taiwan

[21] Appl. No.: 789,286

[22] Filed: Jan. 28, 1997

[51] Int. Cl.[6] ..... G04B 19/30; G04B 19/32; G04B 19/02

[52] U.S. Cl. ..... 368/67; 368/227; 368/228; 368/238

[58] Field of Search ..... 368/76, 80, 223, 368/226, 227, 228, 232, 238

[56] References Cited

U.S. PATENT DOCUMENTS

| | | | |
|---|---|---|---|
| 2,655,783 | 10/1953 | Uschkamp | 368/223 |
| 3,079,748 | 3/1963 | Hultquist | 368/226 |
| 4,775,964 | 10/1988 | Alessio et al. | 368/67 |
| 4,993,005 | 2/1991 | Watanabe | 368/226 |
| 4,995,022 | 2/1991 | Ikeda et al. | 368/226 |
| 5,025,429 | 6/1991 | Watanabe | 368/238 |
| 5,426,621 | 6/1995 | Akasaka | 368/226 |

*Primary Examiner*—Vit W. Miska

[57] ABSTRACT

An illuminating timepiece includes: a casing having a plurality of hour numerals circumferentially disposed on a chapter ring of a dial of the casing, a plurality of stator illuminators each formed on each hour numeral on the dial, a first pointer or an hour hand rotatably mounted in the casing having at least a first rotor illuminator formed on the first pointer, a second pointer or a minute hand rotatably mounted in the casing having at least a second rotor illuminator formed on the second pointer, and an electric control device secured in the casing for subsequently switching on or off the illuminators in each pre-determined time interval for a clear read-out of time in a night or dark place.

5 Claims, 4 Drawing Sheets

ILLUMINATING TIMEPIECE

BACKGROUND OF THE INVENTION

In order to clearly watch time as shown on a clock or a watch in the night or in a dark place, a fluorescent illuminative surface or an optical reflective material may be formed or coated on the dial surface or on the hands of the clock or watch for helping reading of time in the night and darkness. However, the fluorescent or reflective surface on the clock or watch is not bright enough for a clear read-out of time from the conventional clock or watch.

The present inventor ha s found the drawbacks of the conventional clock or watch, and in vented the present illuminating timepiece.

SUMMARY OF THE INVENTION

The object of the present invention is to provide an illuminating timepiece including: a casing having a plurality of hour numerals circumferentially disposed on a chapter ring of a dial of the casing, a plurality of stator illuminators each formed on each hour numeral on the dial, a first pointer or an hour hand rotatably mounted in the casing having at least a first rotor illuminator formed on the first pointer, a second pointer or a minute hand rotatably mounted in the casing having at least a second rotor illuminator formed on the second pointer, and an electric control device secured in the casing for powering and lighting up the illuminators for a clear read-out of time in a night or dark place.

DETAILED DESCRIPTION

Figure 1:
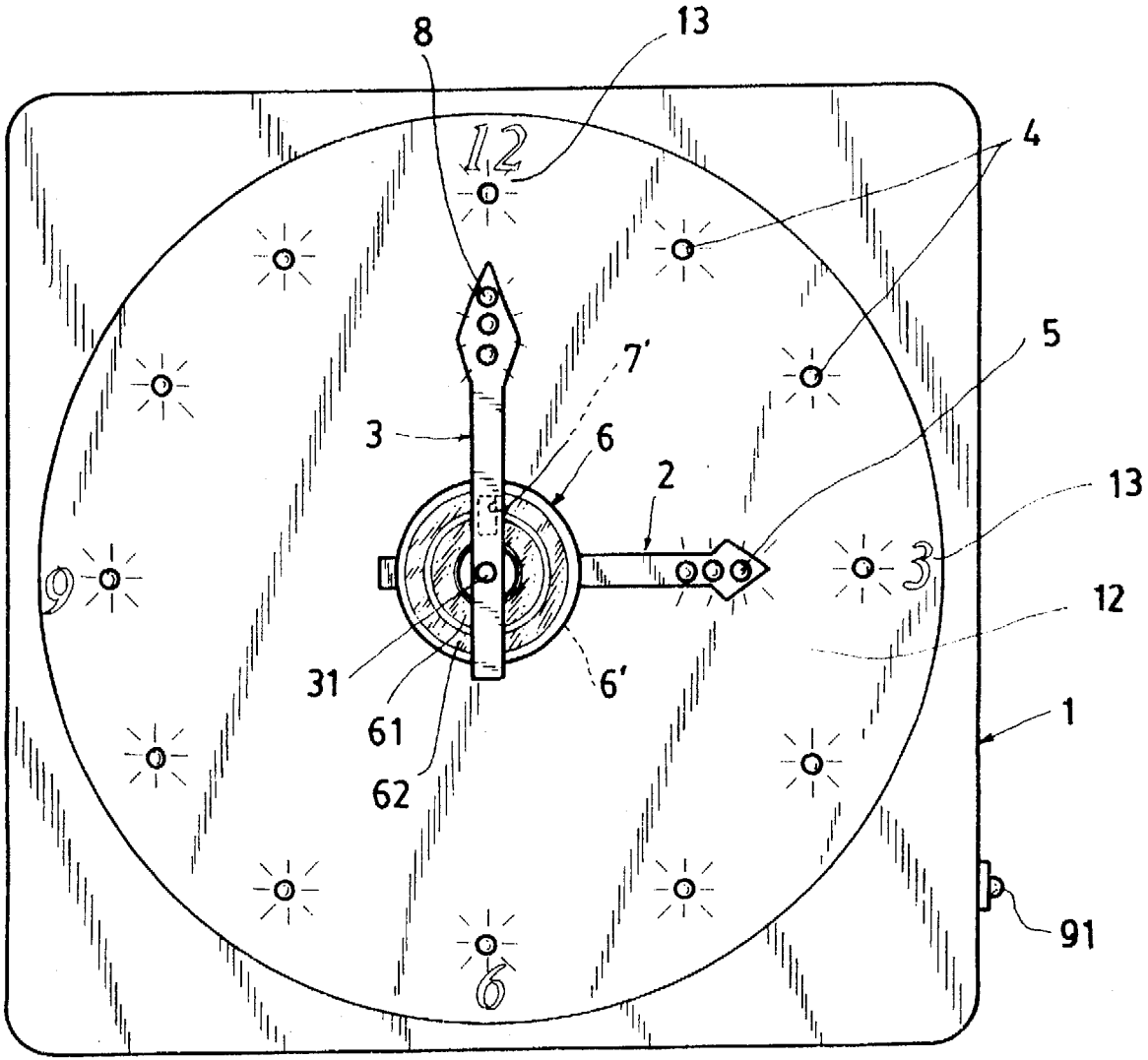
FIG. 1 an illustration of the present invention.

As shown in the drawing figures, a preferred embodiment of illuminating timepiece including clock and watch of the present invention comprises: a casing 1 having a driving means 11 and a dial 12 circumferentially formed with a plurality of hour numerals 13 (e.g., 1, 2, 3, . . . 12) on the dial 12; a first pointer or hour hand 2 having a shaft 21 rotatably mounted on the driving means 11 of the casing 1; a second pointer or minute hand 3 having a spindle 31 rotatably mounted on the driving means 11 of the casing 1; a plurality of stator illuminators 4 with each stator illuminator 4 secured on each hour numeral 13 formed on the dial 12 of the casing 1 and each having a positive-pole wire 41 and a negative-pole wire 42 respectively connected to a positive pole and a negative pole of a power source; at least a first rotor illuminator 5 secured on the first pointer 2 having a positive-pole wire 51 and a negative-pole wire 52 respectively connected to the positve and negative poles of the power source; a first conducting disk 6 and a second conducting disk 6' disposed on opposite sides of the first pointer 2 for electrical conducting through a first and a second brush means 7, 7'; at least a second rotor illuminator 8 secured on the second pointer 3 having a positive-pole wire 81 and a negative-pole wire 82 respectively connected to two poles of the power source; and an electric control means 9 including the power source for powering the illuminators 4, 5, 8 through the brush means 7, 7' and the conducting disks 6, 6'.

The hand for indicating seconds (besides hour and minute) is not described in this specification. It may also be provided with illuminators on a second hand, not limited in this invention.

The number of illuminators 5, 8 are not limited in the present invention. It depends upon the size of the clock or watch, and upon the illuminating brightness as desired in the dark environment or night time.

The illuminators 4, 5, 8 may be selected from: light emitting diode (LED), and may be different in colors from one another, not limited in this invention.

The conducting disk 6, 6'; and the brush means 7, 7' may also be designated as "electric conducting system" for supplying power to the illuminators 4, 5, 8 for their illumination.

The first conducting disk 6, disposed on a top or outer surface of the first pointer 2, and adjacent to the second brush means 7', includes: a substrate disk 60 generally circular shaped and made of electrically insulative material having a central hole **6*a* formed in the disk 60 for passing the shaft 21 of the first pointer 2 through the central hole 6*a*; a first annular ring 61 made of electrically conductive material and concentrically formed on the substrate disk 60; a second annular ring 62 made of electrically conductive material and concentrically formed on the substrate disk 60 to dispose around the first annular ring 61 having an annular insulative partition 65 sandwiched between the first and the second annular rings 61, 62; a positive-pole wire 63 electrically connected between the first annular ring 61 and the positive-pole wire 51 of the first rotor illuminator 5; and a negative-pole wire 64 electrically connected between the second annular ring 62 and the negative-pole wire 52 of the first rotor illuminator 5; with the positive-pole wire 63 and the negative-pole wire 64** respectively connected to two poles of the power source.

The width, diameter, or thickness of the rings 61, 62, and of the disk 6, 6' are not limited in the present invention. For making the disk 6, 6', a round fiber-glass reinforced plastic disk may be printed, electroplated, or processed with the conductive annular rings 61, 62, and further treated to be abrasion-resistant such as plated with nickel or chromium surface-finishing materials by any conventional processing or treatment methods, not limited in the present invention.

For making the electric wire or power connection system of the present invention to be a printed circuit board (PCB), either single layer or multiple layers or laminated layers of the PCB may be provided, not limited in accordance with the present invention.

The conducting disks 6, 6' and the first pointer 2 may be integrally formed to be rotatably mounted on the driving means 11 of the casing 1.

The first brush means 7 may also be integrally formed on the dial 12 of the casing 1; while the second brush means 7 be integrally formed with the second pointer 3 for forming a compact timepiece with minimized volume.

The second conducting disk 6', disposed on a bottom surface of the first pointer 2, and adjacent to the first brush means 7, includes: a bottom disk 60' generally circular shaped and made of electrically insulative material having a central hole 6a formed in the disk 60' for passing the shaft 21 of the first pointer 2 through the central hole 6a; a first annular bottom ring 61' made of electrically conductive material and concentrically formed on the bottom disk 60'; a second annular bottom ring 62' made of electrically conductive material and concentrically formed on the bottom disk 60' to dispose around the first annular bottom ring 61' having an annular insulative partition 65' sandwiched between the first and the second annular bottom rings 61', 62'; a positive-pole bottom wire 63' electrically connected between the first annular bottom ring 61' and the first annular ring 61 of the first conducting disk 6, and electrically connected to the positive-pole wire 51 of the first rotor illuminator 5; and a negative-pole bottom wire 64' electrically connected between the second annular bottom ring 62' and the second annular ring 62 of the first conducting disk 6, and electrically connected to the negative-pole wire 52 of the first rotor illuminator 5; with the positive-pole bottom wire 63' and the negative-pole bottom wire 64' respectively connected to two poles of the power source.

If the two conducting disks 6, 6' are bonded on opposite sides of the first pointer 2 as close as possible, the wires 63, 63', 64, 64' can then be shortened or even eliminated by modifying the present invention.

Figure 2:
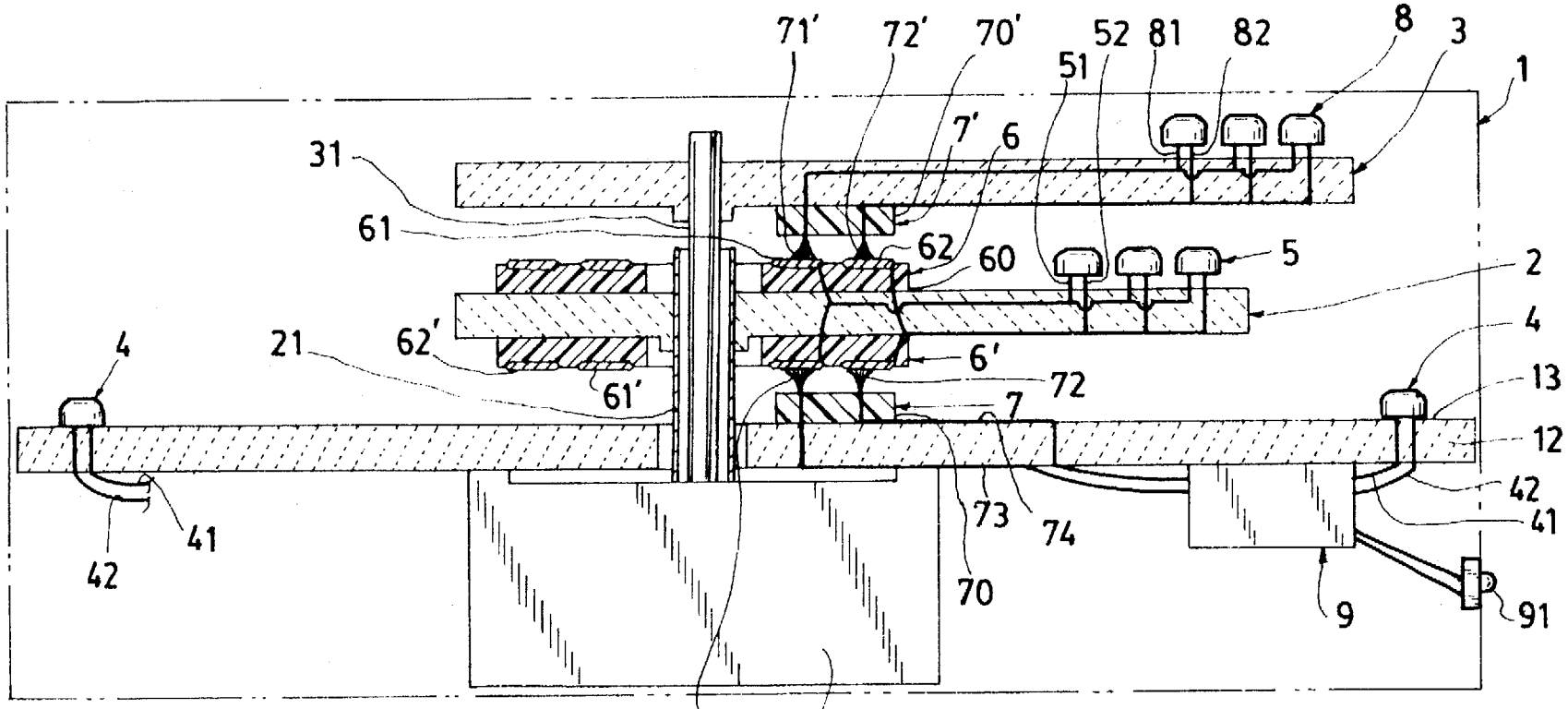
FIG. 2 is a partial sectional drawing of the present invention.
Figure 5:
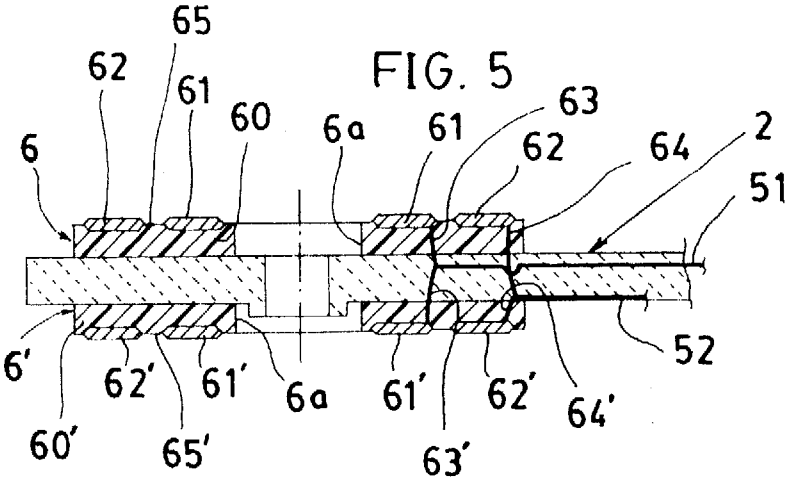
FIG. 5 is a sectional drawing of two conducting disks disposed on opposite sides of the first pointer of the present invention.
Figure 6:
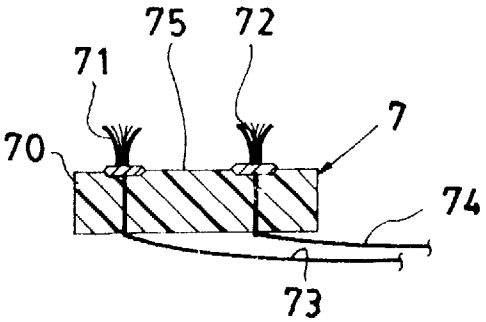
FIG. 6 shows a first brush means of the present invention.
Figure 4:
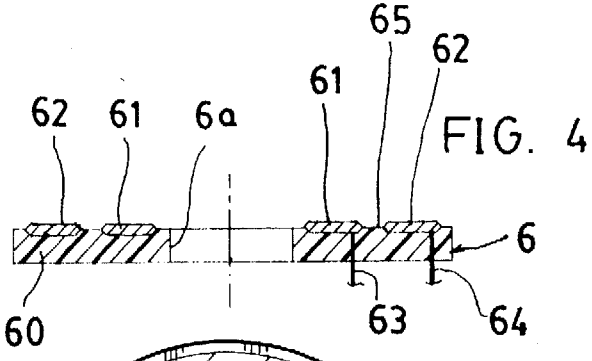
FIG. 4 is a sectional drawing of the conducting disk as shown in FIG. 3.
Figure 3:
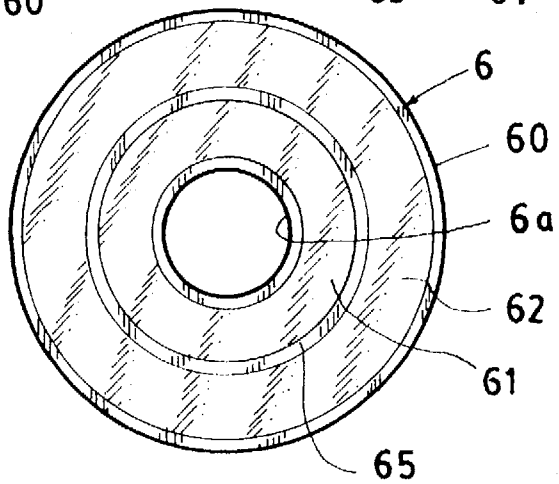
FIG. 3 top view of a conducting disk of the present invention.

The first brush means 7 as shown in FIGS. 6, 2 is positioned under the second conducting disk 6', and includes: a substrate pad 70 secured on the dial 12 of the casing 1 and made of electrically insulative material, a first brush 71 made of electrically conductive materials such as phosphorous-copper wires or wire strands for rotatably contacting the first annular bottom ring 61' of the second conducting disk 6', a second brush 72 made of electrically conductive materials for rotatably contacting the second annular bottom ring 62' of the second conducting disk 6' and separating from the first brush 71 with an annular insulative partition 75, a positive-pole wire 73 electrically connected between the first brush 71 and a positive pole of the power source, and a negative-pole wire 74 electrically connected between the second brush 72 and a negative pole of the power source.

Other electrically conductive brushes or contactors slidably rotatably contacting the annular bottom rings of the conducting disk 6' may also be used in this invention, not restricted to metallic brush.

Figure 7:
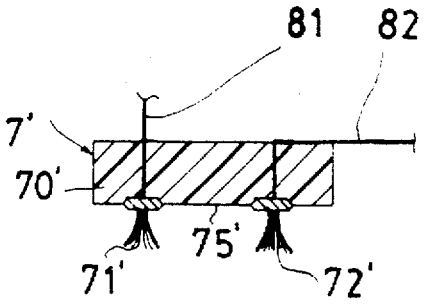
FIG. 7 shows a second brush means of the present invention.

The second brush means 7' as shown in FIGS. 7, 2 is positioned above the first conducting disk 6, and includes: a bottom pad 70' secured on a bottom of the second pointer 3 and made of electrically insulative material, a positive-pole brush 71' made of electrically conductive materials such as phosphorous-copper wires or wire strands for rotatably contacting the first annular ring 61 of the first conducting disk 6, a negative-pole brush 72' made of electrically conductive materials for rotatably contacting the second annular ring 62 of the first conducting disk 6 and separating from the positive-pole brush 71' with an annular insulative partition 75', with the positive-pole brush 71' electrically connected to a positive-pole wire 81 of the second rotor illuminator 8, and the negative-pole brush 72' electrically connected to a negative-pole wire 82 of the second rotor illuminator 8.

The electric control means 9 may be simply a trigger switch 91 protruding outwardly from the casing 1 for switching on or off the power supplied from a power source such as a battory stored in the casing 1 to the illuminators 4, 5, 8 for lighting up the illuminators for a clear read-out of the time as shown by the first and second pointer 2, 3 respectively rotating on the dial 12 or for switching off the illuminators.

Figure 8:
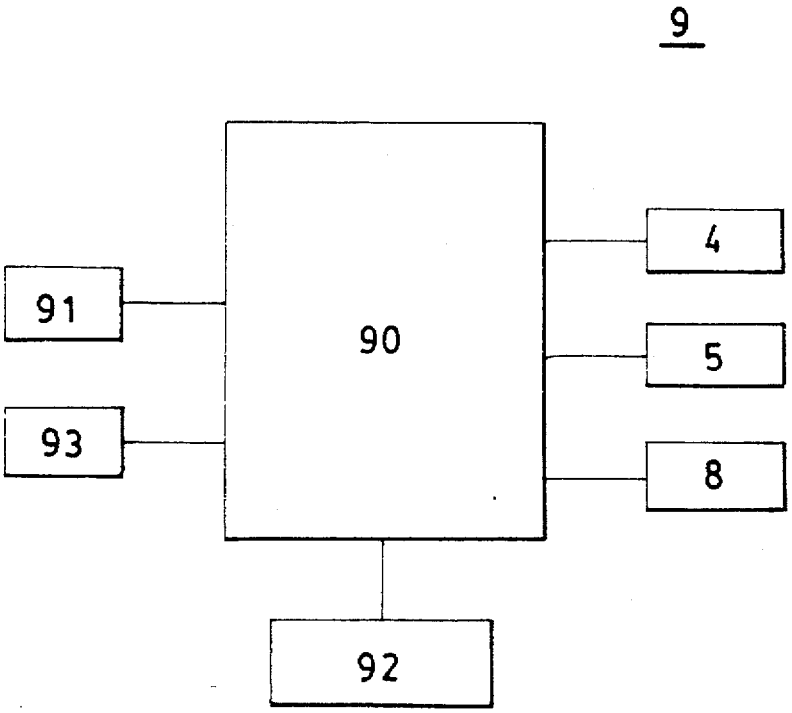
FIG. 8 shows a block diagram of the electric control means.

The electric control means 9 of the present invention as shown in FIG. 8 includes: a power source 92; an electronic controller 90, electrically connected with the power source 92, which may be a microprocessor or an integrated circuit pre-recorded with a timing control sequence for subsequently alternatively switching on or off the illuminators 4, 5, 8 in each pre-determined time interval (not limited in the present invention) for saving electric energy of the power source; a trigger switch 91 electrically connected to the electronic controller 90 for switching on a power supplied to the illuminators for lighting up the illuminators for an instant read-out of the time shown on the dial; and a photo-sensitive switch 93 electrically connected in parallel with the trigger switch 91 to the electronic controller 90 for automatically actuating the electronic controller 90 at night time or under darkness for executing the timing control sequence of the electronic controller 90 for alternatively switching on or off the illuminators.

The illuminators 5, 8, according to this invention, are designated with "rotor" illuminators because of their rotational relationship with respect to the static "stator" illuminators 4.

Upon actuation of the electric control means 9 of the present invention, the illuminators 5, 8 on the hour hand 2 and the minute hand 3 as well as the illuminators 4 on the hour numerals 13 on the dial 12 will be lit up for bright illuminative vision of the clock or watch for a clear reading of time directly from the timepiece to be much improved over the conventional clock or watch having a dim or unclear dial and pointer surface even coated with optical reflective materials.

The present invention may be modified without departing from the spirit and scope of this invention.

I claim:

1. An illuminating timepiece comprising:

a casing (1) having a dial circumferentially formed with a plurality of hour numerals on the dial;

a first pointer (2) for indicating a first time period rotatably mounted on said casing, having at least a first rotor illuminator (5) made of light emitting diode and secured on said first pointer;

a second pointer (3) for indicating a second time period rotatably mounted on said casing, having at least a second rotor illuminator (8) made of light emitting diode and secured on said second pointer;

a plurality of stator illuminators (4) made of light emitting diodes circumferentially disposed on said dial, each said stator illuminator corresponding to and positioned at each said hour numeral on said dial, each said illuminator electrically connected to two poles of a power source of an electric control means (9);

a first conducting disk (6) secured on an outer surface of said first pointer (2);

a second conducting disk (6') secured on a bottom of said first pointer (2);

a first brush means (7) secured on said dial (12) under said conducting disks (6', 6), and electrically connected to the electric control means (9) and rotatably electrically contacting said second conducting disk (6') for conducting power from the electric control means (9) to the first rotor illuminator (5) through said first brush means (7) and said second conducting disk (6');

a second brush means (7') secured on a bottom of said second pointer (3) to be electrically connected to said second rotor illuminator (8) and rotatably contacting the first conducting disk (6) for conducting power to the second rotor illuminator (8) through the first brush means (7), the two conducting disks (6', 6) and the second brush means (7'); and the electric control means (9) secured in said casing (1) for controlling illumination of said illuminators (4, 5, 8), said electric control means (9) including: a power source of battery (92): an electronic controller (90) electrically connected with the power source (92) and pre-recorded with a timing control sequence for subsequently alternatively switching on or off the illuminators (4, 5, 8) in each pre-determined time interval; a trigger switch (91) electrically connected to the electronic controller (90) for switching on a power supplied to the illuminators for lighting up the illuminators for an instant read-out of the time shown on the dial; and a photo-sensitive switch (93) electrically connected in parallel with the trigger switch (91) to the electronic controller (90) for automatically actuating the electronic controller (90) at night time or under darkness for executing the timing control sequence of the electronic controller (90) for alternatively switching on or off the illuminators.

2. An illuminating timepiece according to claim 1, wherein said first conducting disk (6), disposed on an outer surface of the first pointer (2), and adjacent to the second brush means (7'), includes: a substrate disk (60) generally circular shaped and made of electrically insulative material having a central hole (6*a*) formed in the disk (60) for passing a shaft (21) of the first pointer (2) through the central hole (6*a*); a first annular ring (61) made of electrically conductive material and concentrically formed on the substarate disk (60); a second annular ring (62) made of electrically conductive material and concentrically formed on the substrate disk (60) to dispose around the first annular ring (61) having an annular insulative partition (65) sandwiched between the first and the second annular rings (61, 62); a positive-pole wire (63) electrically connected between the first annular ring (61) and a positive-pole wire (51) of the first rotor illuminator (5); and a negative-pole wire (64) electrically connected between the second annular ring (62) and a negative-pole wire (52) of the first rotor illuminator (5); with the positive-pole wire (63) and the negative-pole wire (64) respectively connected to two poles of the power source.

3. An illuminating timepiece according to claim 1, wherein said second conducting disk (6'), disposed on a bottom surface of the first pointer (2), and adjacent to the first brush means (7), includes: a bottom disk (60') generally circular shaped and made of electrically insulative material having a central hole (6*a*) formed in the disk (60') for passing the shaft (21) of the first pointer (2) through the central hole (6*a*); a first annular bottom ring (61') made of electrically conductive material and concentrically formed on the bottom disk (60'); a second annular bottom ring (62') made of electrically conductive material and concentrically formed on the bottom disk (60') to dispose around the first annular bottom ring (61') having an annular insulative partition (65') sandwiched between the first and the second annular bottom rings (61', 62'); a positive-pole bottom wire (63') electrically connected between the first annular bottom ring (61') and the first annular ring (61) of the first conducting disk (6), and electrically connected to a positive-pole wire (51) of the first rotor illuminator (5); and a negative-pole bottom wire (64') electrically connected between the second annular bottom ring (62') and the second annular ring (62) of the first conducting disk (6), and electrically connected to a negative-pole wire (52) of the first rotor illuminator (5); with the positive-pole bottom wire (63') and the negative-pole bottom wire (64') respectively connected to two poles of the power source.

4. An illuminating timepiece according to claim 1, wherein said first brush means (7) is positioned under the second conducting disk (6'), and includes: a substrate pad (70) secured on the dial (12) of the casing (1) and made of electrically insulative material, a first brush (71) made of electrically conductive materials for rotatably contacting the first annular bottom ring (61') of the second conducting disk (6'), a second brush (72) made of electrically conductive materials for rotatably contacting the second annular bottom ring (62') of the second conducting disk (6') and separating from the first brush (71) with an annular insulative partition (75), a positive-pole wire (73) electrically connected between the first brush (71) and a positive pole of the power source, and a negative-pole wire (74) electrically connected between the second brush (72) and a negative pole of the power source.

5. An illuminating timepiece according to claim 1, wherein said second brush means (7') is positioned above the first conducting disk (6), and includes: a bottom pad (70') secured on a bottom of the second pointer (3) and made of electrically insulative material, a positive-pole brush (71') made of electrically conductive materials for rotatably contacting the first annular ring (61) of the first conducting disk (6), a negative-pole brush (72') made of electrically conductive materials for rotatably contacting the second annular ring (62) of the first conducting disk (6) and separating from the positive-pole brush (71') with an annular insulative partition (75'), with the positive-pole brush (71') electrically connected to a positive-pole wire (81) of the second rotor illuminator (8) and the negative-pole brush (72') electrically connected to a negative-pole wire (82) of the second rotor illuminator (8).

* * * * *